US006161367A

United States Patent [19]

Walter

[11] Patent Number: 6,161,367

[45] Date of Patent: Dec. 19, 2000

[54] PROCESS AND PACKING MACHINE FOR MANUFACTURING FILLED DRINKING CUPS

[75] Inventor: Kurt Walter, Glauburg, Germany

[73] Assignee: Hassia Verpackungsmaschinen GmbH, Ranstadt, Germany

[21] Appl. No.: 09/294,613

[22] Filed: Apr. 19, 1999

[30] Foreign Application Priority Data

Apr. 21, 1998 [DE] Germany ..... 198 17 737

[51] Int. Cl.[7] ..... B65B 7/28; B65B 61/18

[52] U.S. Cl. ..... 53/478; 53/478; 53/487; 53/133.3; 53/307; 53/329.3

[58] Field of Search ..... 53/133.3, 329.3, 53/329.5, 307, 412, 478, 487

[56] References Cited

U.S. PATENT DOCUMENTS

| | | | |
|---|---|---|---|
| 2,232,783 | 2/1941 | Hausheer | 53/133.3 |
| 3,509,682 | 5/1970 | Logemann | 53/307 |
| 4,065,909 | 1/1978 | Mueller | 53/307 |
| 4,625,498 | 12/1986 | Parsons | 53/329.5 |
| 4,816,110 | 3/1989 | Foldesi et al. | 53/307 |

FOREIGN PATENT DOCUMENTS

| | | |
|---|---|---|
| 81 18 904 | 10/1981 | Germany . |
| 39 28 654 | 3/1991 | Germany . |
| 2 243 137 | 10/1991 | United Kingdom . |

*Primary Examiner*—John Sipos

*Attorney, Agent, or Firm*—Collard & Roe, P.C.

[57] ABSTRACT

The invention is concerned with a process of manufacturing filled drinking cups closed by cover foil blanks heat-sealed thereto and formed by deep-drawing from a thermoplastic packing material strip, comprising a beaded peripheral flange, with the cover foil blanks being provided with a pull flap. According to the invention the method includes the following steps:

cyclically feeding the packing material strip loaded with the deep-drawn and filled cups underneath a cover foil blank transfer means;

taking up the cover foil blanks from the transfer means, with the pull flaps, during transfer of the cover foil blanks to the packing material strip, being positioned in a direction substantially vertical to the extension plane of the blanks, and the blanks with the upright pull flaps above the cup openings being applied to the packing material strip;

sealing the margins of the cover foil blanks to the unmolded areas of the packing material strip about the cup openings;

bending the upright flaps during the advance movement of the packing material strip;

punching the cups from the packing material strip along a punching contour line extending in parallel to and at a space from the circumferential contour of the cover foil blanks; and transferring the punched cups into a beading means wherein the peripheral flange portion projecting relative to the cover foil blanks is downwardly beaded.

12 Claims, 3 Drawing Sheets

PROCESS AND PACKING MACHINE FOR MANUFACTURING FILLED DRINKING CUPS

BACKGROUND OF THE INVENTION

1. Field of the Invention

The present invention is concerned with a process and a packing machine for manufacturing filled drinking cups closed by cover foil blanks heat-sealed thereto and formed by deepdrawing from a continuous sheet of thermoplastic packing material and comprising a beaded peripheral flange, with the cover foil blanks thereof being provided with a pull flap.

2. Description of Prior Art

Drinking cups of this type comprising beaded peripheral flanges and pull flaps provided on the cover foil blank are known in the art, for example, from British Patent Application No. 2 243 137 A. Drinking cups according to German Utility Model 81 18 904 also are provided with beaded peripheral flanges; however, the cover foil blanks thereof do not contain pull flaps. In both cases, loading and sealing is effected through the cover foil blanks on the finished cup-shaped receptacles, so that also the cover foil blanks along with the flaps according to British Patent Application No. 2243137 can readily be hermetically heat-sealed.

Moreover, German Patent Application No. 39 28 654 A1 describes cup-shaped packages the cover foils of which, it is true, do have a pull flap; however, the peripheral flange of such packages is not downwardly beaded so as to afford comfort to the user's lips. The cover foil blanks, during a cyclical continuous manufacture, are not applied and sealed as individual blanks to the strip of packing material provided with cup-shaped moldings, but a sheet of cover foil is rather applied to the strip of packing material to be circumferentially sealed about the cup openings thereof, whereupon only the flaps will have to be punched from the cover foil sheet without affecting the strip of packing material to be then erected and bent in order to enable the sealed cup-shaped packages to be punched thereafter without affecting the bent pull flaps. Apart from the mechanical efforts required for specifically punching alone the flaps from the cover foil sheet, involving substantial disadvantages as this can only be done against the more or less soft material of the strip of packing material, and for erecting and bending the pull flaps, in this process the cover foil sheet will have to correspond to the full width of the strip of packing material resulting in substantially larger waste compared to premanufactured cover foil blanks to be applied and heat-sealed to the cup flanges as individual parts in accordance with the usual practice employed with drinking cups of the aforementioned type.

As the cross-section of the cover foil blanks in the cup-shaped receptacles according to German Patent Application No. 39 28 654 completely covers the peripheral flanges of the cups, the beading thereof cannot be considered either as also the margins of the cover foil blanks heat-sealed thereto would be seized by the bead which, in turn, would affect a smooth withdrawal of the cover foil blanks if drinking therefrom is intended.

OBJECTS OF THE INVENTION

It is the object of the invention to provide a process of manufacturing loaded and heat-sealed drinking cups which, on the one hand, enables a cyclical and continuous and, hence, economical manufacture in the sense of German Patent Application No. 39 28 654, involving low mechanical efforts, a close raster arrangement of the cups within the strip of packing material despite the fact that pull flaps have already been provided on the cover foils, a minimized cover foil waste and a design of the cup margin affording comfort to the lips.

Another object of the invention resides in turning around the pull flaps during passage thereof to the strip of packing material while simultaneously erecting them.

Moreover, it is an object of the invention to attach the cover foil blanks applied to the strip of packing material by pre-sealing them to the strip of packing material.

Finally, it is an object of the invention to provide a packing machine for carrying out the process.

SUMMARY OF THE INVENTION

It has been found that these and other objects and advantages can be obtained by a packing method which includes the following steps:

Cyclically feeding the strip of packing material furnished with the deep-drawn and loaded cups underneath a magazine containing the cover foil blanks; taking-over the cover foil blanks from the transfer means, with the pull flaps, during transfer of the cover foil blanks to the strip of packing material, being placed in a direction normal to the plane of extension of the blanks, and the blanks with the flap standing upright, above the cup openings, being placed upon the strip of packing material; heat-sealing the margins of the cover foil blanks to the unmolded areas of the strip of packing material about the cup openings; bending the flaps substantially upright during the advance movement of the strip of packing material; punching the cups from the strip of packing material along a punching contour line extending in parallel to and at a distance from the circumferential contour of the cover foil blanks, and transferring the punched cups to a beading station wherein the peripheral flange portion protruding relative to the cover foil is beaded downwardly.

The process of the invention fulfills the requirements placed upon it, wherein, as opposed to the process according to German Patent Application No. 39 28 654 A1, no cover foil sheet directly and continuously fed to the strip of packing material is used but cover foil blanks already cut to size and provided with pull flaps are applied to the strip of packing material.

The cover foil blanks, already previously cut or punched from the cover foil sheet can, of course, be cut from such a cover foil sheet in close relationship, i.e. independently of the cup raster in the strip of packing material for subsequent magazination. Apart from the storage of such cover foil blanks in a magazine and the take-over thereof from a magazine, it is also possible to take over the cover foil blanks punched immediately prior to the take-over from a cover foil sheet, from a corresponding puncher; in that case, a major cover foil waste would, however, have to be accepted, as the cover foil punch raster would have to correspond to the cup raster in the strip of packing material. For this reason, the take-over of finished cover foil blanks from a magazine would be preferred. Moreover, the cup raster in the strip of packing material need not take into account the pull flaps already provided on the cover foil sections, but with respect to the raster arrangement of the cups in the strip of packing material merely the required peripheral flange size of the cups will have to be considered in order to be able to bead the said peripheral flanges at the end of the entire manufacturing process in a manner beneficial to the lips.

The packing machine of the invention for carrying out the process comprises molding, loading, covering, sealing and punching stations arranged in series in the frame of a machine in the feeding direction of the strip of packing material along the feeding line of the strip of packing material.

In accordance with the invention it is essential that a rotatable transfer element movable up and down and being provided with suction heads be arranged in the covering station between the feed line of the strip of packing material and a cover foil blank holding element arranged thereabove. Moreover, arranged in the peripheral regulating path of the transfer element, in spaced relationship and above the feed line of the strip of packing material, is an erecting ledge for the pull flaps, which exceeds the length of the flaps. Finally, arranged between the sealing station and the punching station are a bending element for the flaps and, behind the punching station, a peripheral flange beading station.

BRIEF DESCRIPTION OF THE DRAWINGS

Various other objects and advantages of the invention will become apparent from the following detailed description, claims, and drawings appended hereto, wherein

DESCRIPTION OF PREFERRED EMBODIMENTS

Figure 1:
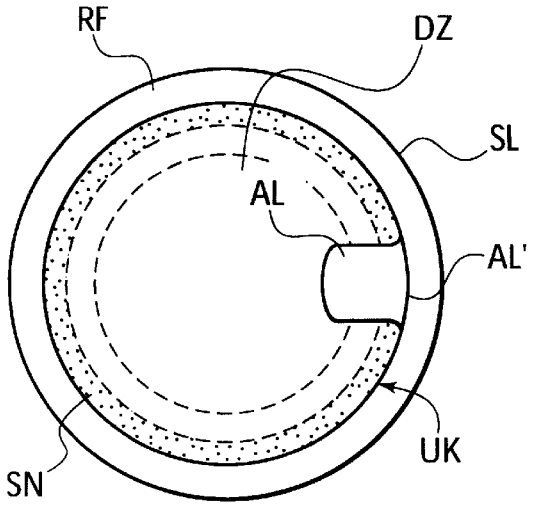
FIG. 1 is a plan view of drinking cup with a peripheral flange not yet beaded.
Figure 2:
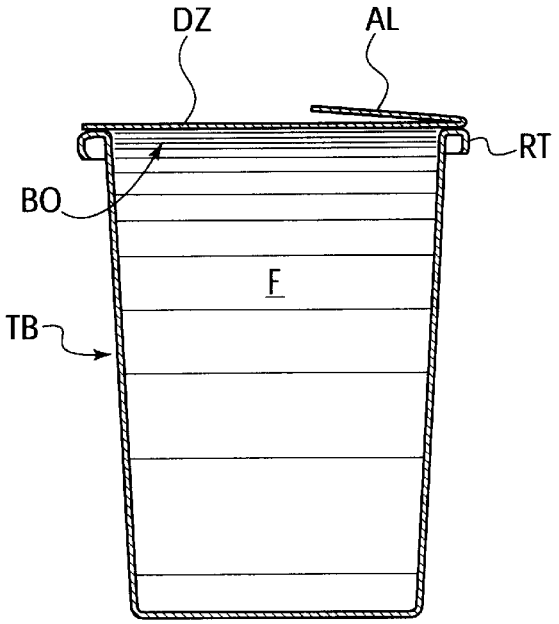
FIG. 2 is a sectional view of the drinking cup of FIG. 1, with the peripheral flange beaded.

The drinking cup(s) TB to be produced according to the process of the invention, for the sake of completeness, are shown in FIGS. 1,2 as a single item, wherein reference character DZ refers to the cover foil blank, AL to the pull flap thereof, RF to the peripheral flange, RT to the beaded peripheral flange thereof and SN to the circumferential welding seam by means of which the cover foil blank DZ is heat-sealed to the peripheral flange RF in a liquid-tight way. The pull flap AL in the finished cup containing the load F is flatly seated on the cover foil blank DZ as shown in FIG. 2.

Figure 3A:
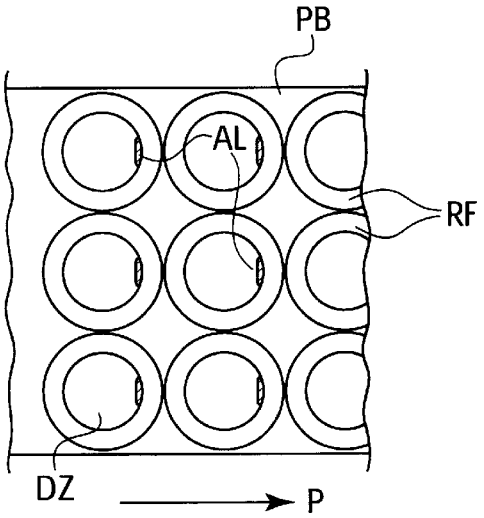
FIG. 3A show the raster arrangement of the deep-drawn cups in the strip of packing material.
Figure 3B:
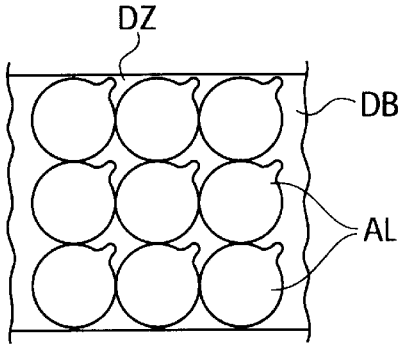
FIG. 3B shows the arrangement of the cover foil blanks punched, for preparatory purposes, from the cover foil sheet for subsequent storage in a magazine.

Also, for the sake of order, FIGS. 3A and 3B, on the one hand, show the arrangement of the deep-drawn cups with their peripheral flanges RF in the strip of packing material PB inclusive of the cover foil blanks DZ already heat-sealed thereto, and FIG. 3B shows the close arrangement of the cover foil blank DZ in a cover foil sheet DB, which close arrangement is completely independent of the raster arrangement of the cups in the strip of packing material PB. The resultant waste of cover foil in that case is thus minimizable. However, this will require the cover foil blanks DZ to be stored in a magazine. A correspondingly close raster arrangement practically arises also for the strip of packing material PB as the raster arrangement of the cups with the peripheral flanges RF can be selected as close as possible irrespective of the pull flaps AL which, according to FIG. 3A are substantially upright.

Figure 4:
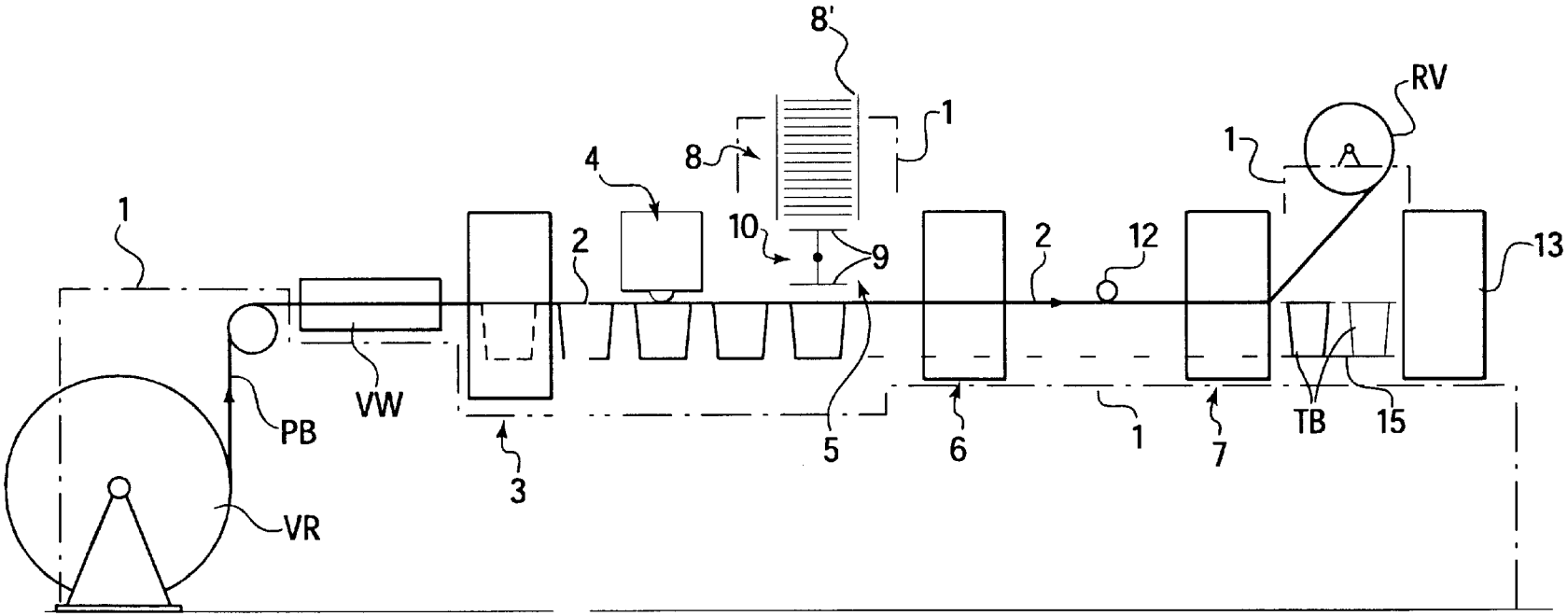
FIG. 4 schematically shows, in side view, the packing machine for carrying out the process.

The packing machine only schematically shown in FIG. 4 in side view, in known manner, comprises molding, loading, covering, sealing and punching stations 3 to 7 arranged in series in the frame of a machine I in the feeding direction of the strip of packing material PB along the feeding line 2 of the strip of packing material. The strip of packing material PB cyclically withdrawn from a reel VR by means of feed elements (not shown in any detail) first runs, in usual manner, through preheating elements VW past the aforementioned individual stations 3 through 7 which—except for the covering station 5—do not require any special explanation because they are known per se, for which reason the illustration of all driving elements, control systems, loading elements and the like related to the said stations has been foregone.

Figure 5:
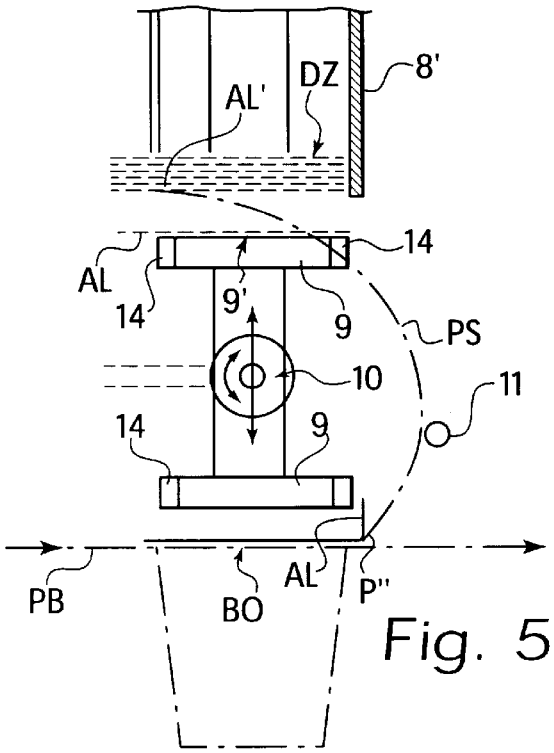
FIG. 5 schematically shows, on an enlarged scale, the covering station with the associated magazine.

Now, it is essential for a packing machine of this type that arranged in the covering station 5, between the feeding line 2 of the packing material strip and a cover foil blank feeding element 8 disposed thereabove is a rotating transfer element 10 movable up and down and provided with suction heads 9 (see FIG. 5). Moreover, provided in the peripheral regulating path PS of the transfer element 10 is an erecting ledge 11 for the pull flap AL at a space D above the feeding line 2 of the strip of packing material, which exceeds the length L of the pull flaps AL, and, finally, arranged between the sealing station 6 and the punching station 7 is a pull flap bending element 12 and behind the punching station 7 is arranged a peripheral flange beading station 13. As the drinking cups TB are individually formed behind the punching station 7 (the residual waste RV of the strip of packing material PB according to FIG. 1 being upwardly withdrawn and wound up) a take-up and collecting face 15 is arranged below and behind the punching station 7 from which the individual cups are suitably moved into the beading station 13 yet to be described in greater detail hereinafter with reference to FIG. 8, although beading means of this type are known per se. The phrase „cover foil blank feeding element 8" either (preferably) conveys a magazine 8' or a puncher 8" for punching the cover foil blanks from a cover foil sheet fed to the puncher 8" (see FIG. 7).

The entire manufacturing process of the invention in reference to FIG. 1 is as follows, proceeding from cover foil blanks DZ stored in magazine 8': After having passed through the preheating station VW and the molding and deep-drawing station 3, respectively, in which the cups B are molded into the packing material strip PB in known manner, the cups molded into the packing material strip PB are moved below the loading station 4 for introducing load F, and are then moved into covering station 5 shown on an enlarged scale in FIG. 5 together with the magazine 8' arranged thereabove. In that station 5 the cover foil blanks DZ are removed from the magazine 8', with the pull flaps AL, during transfer of the cover foil blanks DZ to the packing material strip PB, being positioned in a direction approximately vertical to the extension plane of the blanks DZ, with the said blanks DZ with the pull flaps AL standing upright above the cup openings BO being applied to the packing material strip BP. Advantageously, applying the blanks DZ is effected by simultaneously pre-sealing the cover foil blanks DZ to the packing material strip PB to safeguard that the blanks are reliably applied to the packing material strip when the same is cyclically advanced. For this purpose—in reference to FIG. 5—the suction heads 9 of the transfer elements 10 are provided with a presealing jaw 14 surrounding the suction face 9' thereof Further details relating to the said covering station 5 and the function thereof will be described hereinafter in greater detail.

After having passed through station 5, the packing material strip is moved into the actual sealing station 6 wherein the final heat-sealing of the margins of the cover foil blanks DZ to the unmolded areas of the packing material strip PB about the cup openings BO will be performed (see in this respect FIG. 1). In order to prevent a collision of the sealing tool in station 6 with the upright pull flaps AL from occurring, it is easy to make sure that the pull flaps AL do not extend in a direction exactly vertical but in a direction slightly outwardly relative to the plan view face of the blank DZ.

The flaps AL still upright thereafter are then bent during the advance movement of the packing material strip with the aid of a bending element 12 extending across the feeding line 2 of the packing material strip, which element 12 is, for example, in the form of a small roller which, in a suitable manner, is rotatably arranged in the machine frame 1. After bending of the said pull flaps AL, the cups are punched from the packing material strip PB along a punch contour line SL extending in parallel to and at a distance from the circumferential contour UK of the cover foil blanks DZ (see FIG. 3A), followed by the transfer of the punched cups TB via the aforementioned take-up and collecting face 15 into the beading station 13 wherein the peripheral flange portion RT of the cups protruding relative to the cover foil blanks DZ is beaded downwardly in the way as shown in FIG. 2.

The afore-mentioned qualification „along a . . . extending in parallel to and at a distance from the circumferential contour UK . . . " is essential, for, the said space corresponds in size to the beading to be subsequently molded.

Figure 6:
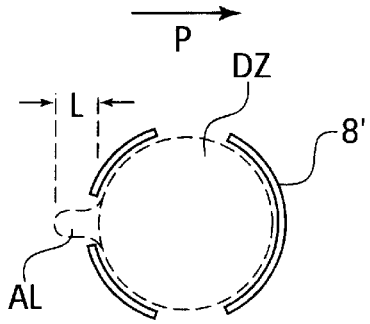
FIG. 6 schematically shows the magazine, in plan view, along with the cover foil blanks.

Concerning the design of the covering station 5 with the associated magazine 8' which is of decisive importance to the whole of the process, reference is again made to FIGS. 5 and 6, with FIG. 6 showing the magazine 8' in plan view along with the cover foil blanks DZ stacked therein and shown in broken lines only, inclusive of their pull flaps AL stored in a direction opposite the feeding direction (see arrow P) of the packing material strip PB in the magazine 8'. This is important because the sucked blanks DZ must be turned around with the transfer element 10, and the flaps ASL are to be moved to the other side, i.e. to the discharge side (see FIG. 5, to the right, bottom).

As previously mentioned, the transfer element 10 along with its two suction heads 9 thereof, by means of a drive (not shown in any closer detail) is rotatable and arranged between the bottom side of the magazine 8' and the packing material strip PB in a manner movable up and down within the part of the machine frame 1 and is provided with a controllable suction connection 10' and, as mentioned before, also comprises an annular heatable pre-sealing jaw 14 surrounding the suction face 9' in order to enable the blanks DZ applied to be immediately pre-fixed to the packing material strip PB by pre-sealing.

During the combined rotating and lowering operation of a cover foil blank DZ discharged from the magazine 8' by means of suction head 9, the flap collar AL' on blank DZ moves along the dash-dotted elliptical arc, reaching position P" due to the turn-around operation. The erecting ledge 11 is stationarily arranged in a manner tangential to the said elliptical regulating path PS, through which ledge, during sweeping, the pull tab AL relative to the plan of the blank DZ is erected or bent, thereby projecting substantially upwardly in a direction substantially vertical to the packing material strip after application thereto, as also shown by FIG. 5. The said upright pull flaps AL, during advance of the packing material strip PB behind the sealing station 6, through the bending element 12 extending across the packing material strip, are placed into a position parallel to the cover foil blank DZ.

Figure 7:
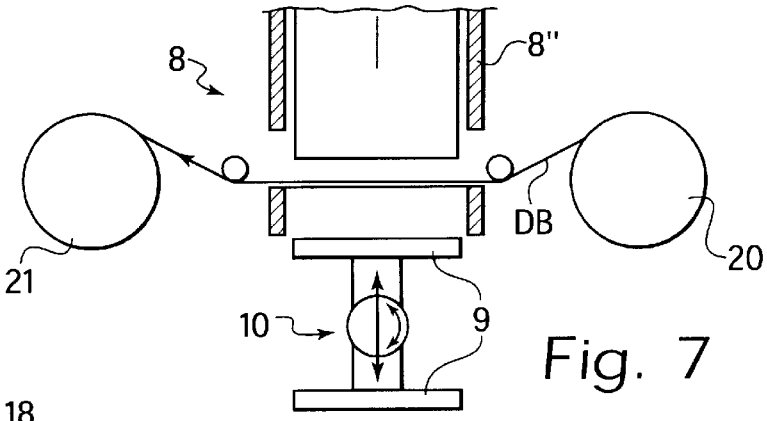
FIG. 7 schematically shows, on an enlarged scale, another embodiment of the covering station.
Figure 8:
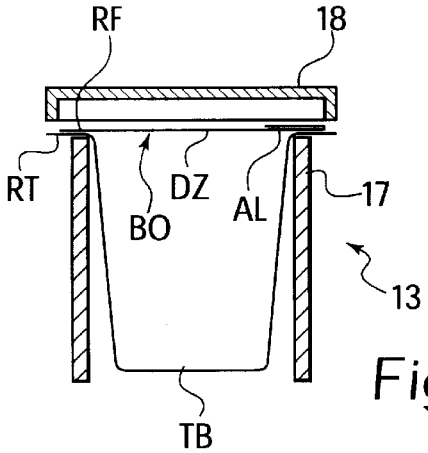
FIG. 8 schematically shows, in cross-section, the beading station.

As to the possibility of designing the cover foil feeding element 8 in the form of a puncher 8", reference is made to FIG. 7. The transfer element 10 and the function thereof remain the same as conveyed by FIG. 5. In his form of embodiment, a cover foil strip DB cyclically runs from a reel 20, as schematically shown, through the puncher 8" to a waste-receiving roll 21, and the cover foil blanks DZ stamped by puncher 8" are taken up directly underneath the puncher by the suction head 9 concerned and, as previously described, are transferred to the packing material strip PB.

Although known per se, the beading station 13 arranged behind the take-up and collecting face 15 is schematically shown along with a drinking cup TB contained therein, which with the peripheral flange RF thereof is so applied to a corresponding abutment 17 conforming to the flange shape that the projecting flange portion RT, during lowering of the beading tool 18, is downwardly beaded.

It will be understood that the afore-going description with the details of exemplary structure is not to be construed in any way to limit the invention, but that modifications may be made thereto without departing from the scope of the invention as set forth in the following claims.

What is claimed is:

1. A process of manufacturing filled drinking cups closed by cover foil blanks heat-sealed thereto and formed by deep-drawing from a thermoplastic packing material strip, comprising a beaded peripheral flange, with the cover foil blanks being provided with a pull flap, including the following steps:

cyclically feeding the packing material strip loaded with the deep-drawn and filled cups underneath a cover foil blank transfer means;

transferring the cover foil blanks to the packing material strip and erecting the pull flaps during transfer of the cover foil blanks into a direction substantially vertical to the extension plane of the blanks, and applying the blanks with the upright pull flaps to the packing material strip;

heat-sealing the margins of the cover foil blanks to the unmolded areas of the packing material strip about the cup openings;

bending the upright flaps during the advance movement of the packing material strip;

punching the cups from the packing material strip along a punching contour line extending in parallel to and at a space from the circumferential contour of the cover foil blanks; and transferring the punched cups into a beading means wherein the peripheral flange portion projecting relative to the cover foil blanks is downwardly beaded.

2. A process according to claim 1, characterized in that the cover foil blanks oriented with the pull flaps in a direction opposite the feeding direction of the packing material strip within the magazine are discharged from the magazine by suction, turned around, lowered against the packing material strip while erecting the pull flaps, and applied to the packing material strip by offsetting the suction position.

3. A process according to claim 2, characterized in that the cover foil blanks applied to the packing material strip immediately after application thereof are pre-sealed to the packing material strip.

4. A process according to claim 1, characterized in that the erection of the pull flaps in a direction vertical to the extension plane of the cover foil blanks is caused by sweeping the cover foil blanks past a stationary ledge.

5. A process according to claim 1, characterized in that the cover foil blanks are taken up from a stack of cover foil blanks.

6. A process according to claim 1, characterized in that the cover foil blanks immediately after their being punched from the cover foil sheet are taken up and transferred to the packing material strip.

7. A packing machine for manufacturing filled drinking cups closed by cover foil blanks heat-sealed thereto and cyclically and continuously deep-drawn from a thermoplastic packing material strip, including a beaded peripheral flange, with the cover foil blanks thereof being provided with a pull flap, which comprises a machine frame on which are arranged in series a molding station, a loading station, a covering station, a sealing station and a punching station, with a transfer element for transferring the cover foil blanks to the packing material strip being provided in the said covering station between the packing material strip feeding line and a feeding element for the cover foil blanks arranged thereabove; with the said transfer element relative to the said feeding element and the packing material strip feeding line being designed to be rotatable and movable up and down; with a stationary erection ledge for the pull flaps of the foil cover blanks moved therealong being provided in the peripheral regulating path of the said transfer element, the erecting ledge being arranged above the packing material strip feeding line at a distance slightly exceeding the length of the pull flaps to erect the pull flap into a vertical direction as the cover foil blank is placed on the packing material strip; with a stationary bending element for bending the pull flaps standing in a direction vertical to the packing material strip being arranged between the said sealing and punching stations; with the said bending element extending across the packing material strip feeding line at a small distance and with a beading station for the peripheral flanges of the punched cups being arranged behind the punching station.

8. A packing machine according to claim 7, characterized in that the transfer element is furnished with suction heads.

9. A packing machine according to claim 8, characterized in that the suction heads of the transfer element are provided with a pre-sealing jaw surrounding the suction face thereof.

10. A packing machine according to claim 7, characterized in that the feeding element for the cover foil blanks are in the form of a magazine.

11. A packing machine according to claim 7, characterized in that the feeding element for the cover foil blanks are designed in the form of a puncher furnished with a cover foil sheet feeder.

12. A packing machine according to claim 7, characterized in that arranged between the punching station and the beading station is a take-up and collecting face for transferring the punched cups into the beading station.

* * * * *